United States Patent [19]

Focke et al.

[11] Patent Number: 4,715,847

[45] Date of Patent: Dec. 29, 1987

[54] PROCESS AND APPARATUS FOR PRODUCING BLANKS FOR PACKS

[75] Inventors: Heinz Focke; Jürgen Focke, both of Verden, Fed. Rep. of Germany

[73] Assignee: Focke & Co., Verden, Fed. Rep. of Germany

[21] Appl. No.: 816,018

[22] Filed: Jan. 3, 1986

[30] Foreign Application Priority Data

Jan. 10, 1985 [DE] Fed. Rep. of Germany ..... 3500547

[51] Int. Cl.[4] ..... B31B 1/00

[52] U.S. Cl. ..... 493/11; 493/60; 493/82; 493/83; 493/365; 493/370; 493/373; 83/49; 83/100; 83/303; 83/334

[58] Field of Search ..... 493/11, 58, 60, 64, 493/82, 83, 362, 365, 370, 373; 83/76, 303, 334, 49, 920, 100; 225/100

[56] References Cited

U.S. PATENT DOCUMENTS

| | | | |
|---|---|---|---|
| 1,310,922 | 7/1919 | Novick | 83/346 |
| 1,762,702 | 6/1930 | Smith | 493/60 |
| 1,924,160 | 8/1933 | Knowlton | 83/303 |
| 2,164,436 | 7/1939 | Waters | 493/335 |
| 2,425,043 | 8/1947 | Moore | 156/218 |
| 2,942,534 | 6/1960 | Boddy | 493/365 |
| 3,314,340 | 4/1967 | Bishop | 493/365 |
| 3,404,607 | 10/1968 | Feick et al. | 493/373 |
| 3,424,607 | 10/1968 | Feick et al. | 493/373 |
| 3,658,220 | 4/1972 | Norton | 493/342 |
| 3,667,663 | 6/1972 | Kacmarcik et al. | 225/100 |
| 3,730,810 | 5/1973 | Klein | 83/76 |
| 3,875,836 | 8/1975 | Hutchinson et al. | 83/100 |
| 3,926,097 | 12/1975 | Santa Maria et al. | 493/365 |
| 3,981,213 | 9/1976 | Lopman | 493/60 |
| 4,599,926 | 7/1986 | Carlson, Jr. et al. | 83/100 |

FOREIGN PATENT DOCUMENTS

| | | |
|---|---|---|
| 116745 | 8/1984 | European Pat. Off. . |
| 364487 | 11/1922 | Fed. Rep. of Germany . |
| 102844 | 3/1926 | Fed. Rep. of Germany . |
| P 6792 | 12/1951 | Fed. Rep. of Germany . |
| 2014522 | 10/1970 | Fed. Rep. of Germany . |
| 2016599 | 10/1970 | Fed. Rep. of Germany . |
| 2018698 | 11/1971 | Fed. Rep. of Germany . |
| 2202307 | 9/1972 | Fed. Rep. of Germany . |
| 2448204 | 5/1975 | Fed. Rep. of Germany . |
| 2530992 | 1/1977 | Fed. Rep. of Germany . |
| 2308968 | 1/1977 | Fed. Rep. of Germany . |
| 2622500 | 1/1977 | Fed. Rep. of Germany . |
| 3138454 | 9/1982 | Fed. Rep. of Germany . |
| 2444634 | 7/1980 | France . |

*Primary Examiner*—Frederick R. Schmidt
*Assistant Examiner*—Robert Showalter
*Attorney, Agent, or Firm*—Sughrue, Mion, Zinn, Macpeak & Seas

[57] ABSTRACT

Blanks (10) for producing folding boxes, etc., are severed from an advancing sheet (11), conveyed continuously, at a constant speed by first drawing rollers specifically by partial severing cuts (cutting lines 33, 34) supplementing one another and made in successive work cycles. The blanks (10) are severed from the sheet (11), with the exception of residual connections (35), and are separated completely from the sheet (11) by tearing as a result of a higher speed of additional drawing roller located downstream of the first rollers.

16 Claims, 9 Drawing Figures

PROCESS AND APPARATUS FOR PRODUCING BLANKS FOR PACKS

DESCRIPTION

Figure 1:
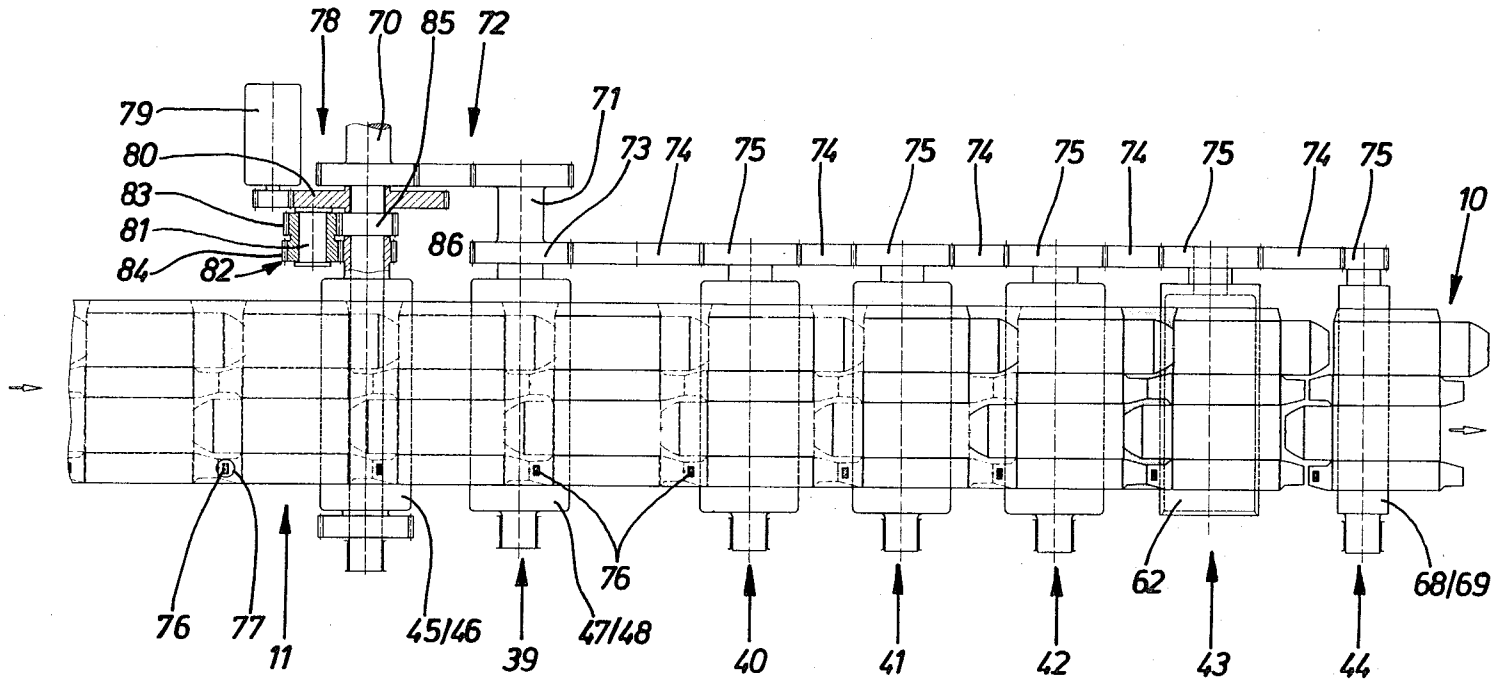

The invention relates to a process for producing blanks for packs (folding cartons, folding boxes) made of paper, cardboard or the like, by severing them from a sheet of packaging material. The invention also relates to an apparatus for producing blanks by using the abovementioned process.

The main aim is to produce blanks for packs in conjunction with a packaging machine and feed the finished blanks directly to the packaging machine. The packs are folding boxes, folding cartons or the like, preferably made of thin cardboard. Folding boxes produced from it are used extensively for the packaging of pharmaceutical products.

The feature peculiar to the design of the blanks is that folding tabs for forming the end faces of the folding box are usually complex and, in order to save material, are arranged so as to engage with one another (intermesh) within the material sheet or sheet of packaging material. Furthermore, side tabs assigned to side walls of the folding box are made with a smaller width than that of the associated side wall. Because the folding tabs are of less width, waste pieces occur when the blanks are stamped or severed.

In practice, blanks of this type have hitherto been produced mainly by plate-like stamping tools which in a work cycle (stamping cycle) stamp out an appropriate number of blanks from a larger sheet of packaging material. After the stamping cycle, the waste pieces are removed by hand. The blanks then have to be brought into a position suitable for subsequent packaging. The outlay in terms of labour is consequently relatively high, and the output of even the following packaging machine is limited.

Production of blanks by severing them from a continuous advancing sheet of packaging material is, however, already known.

The object on which the invention is based is to propose measures for an improved production of blanks, in such a way that output is increased, without the quality of the blanks being impaired.

To achieve this object, the process according to the invention is characterized in that the blanks are severed from the sheet during the advancing transport of the latter, especially during its continuous movement.

The continuous production of blanks makes it possible to achieve a higher output and, furthermore, match the likewise continuous action of the following packaging machine.

According to the invention, the blanks are produced in successive work cycles carried out during the transport movement of the sheet. The blanks are severed in several, especially two successive severing cuts, with the folding tabs being formed at the same time at both ends of the blank. These severing cuts are placed so that each can be made without being damaged by further severing cuts which are necessary. In particular, selection of the successive cuts guarantees that severing cuts located at only a slight distance from one another because of the shape of the folding tabs do not have to be made simultaneously. This applies particularly to severing cuts which extend in the longitudinal direction of the sheet or in its conveyed direction and which are intended for limiting the folding tabs laterally.

Furthermore, embossing to form folding lines within the blank, in particular to delimit box walls, is carried out in successive steps, in such a way that, for example, in a first embossing cycle longitudinal folding lines only and in a subsequent embossing cycle transverse folding lines are formed in the blank.

According to a further proposal of the invention, the severing cuts for severing the blanks from the following sheet are made so that the blanks remain to the very last joined to the sheet by means of thin residual connections. It is thereby possible, in particular, to eliminate mechanically the waste pieces formed in the region of the folding tabs. The blanks are then severed by being torn off, especially as a result of a locally higher transport speed of the sheet or of the particular blank located at the front.

The apparatus according to the invention consists of a plurality of pairs of rollers, between which the sheet of packaging material of the blanks is conveyed. The rollers are each designed as embossing, cutting, pressing-out or drawing rollers. The drive of the pairs of rollers is interconnected and can be controlled, in such a way that the sheet is always conveyed accurately in relation to the fixed pairs of rollers. Corrections are made by means of printed-on control marks.

Figure 2:
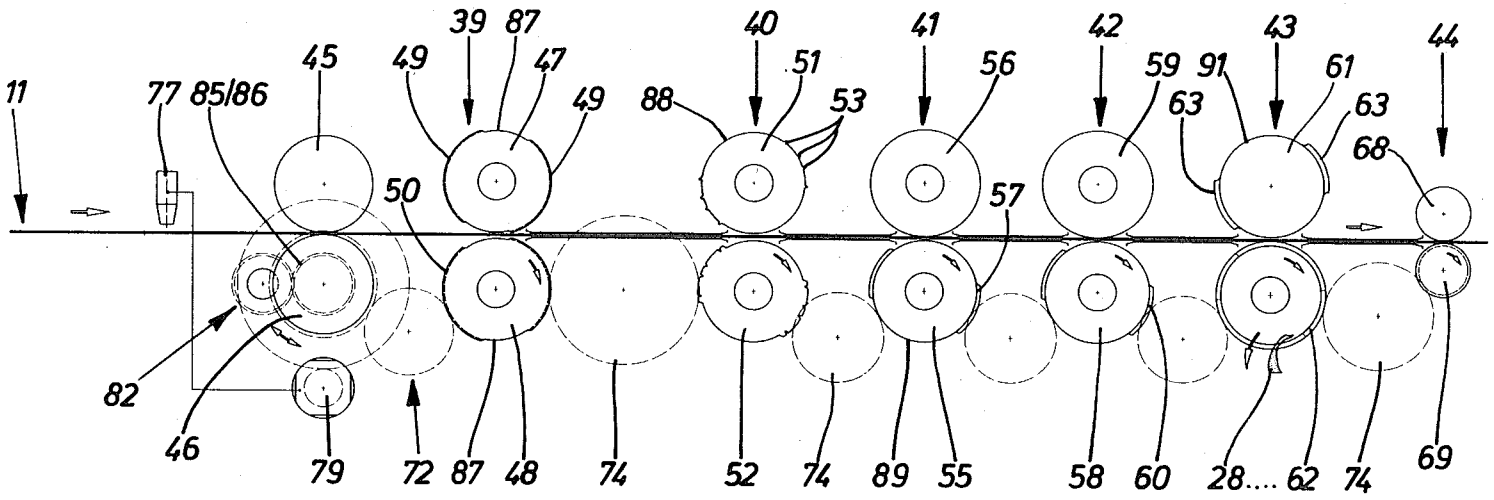
Figure 3:
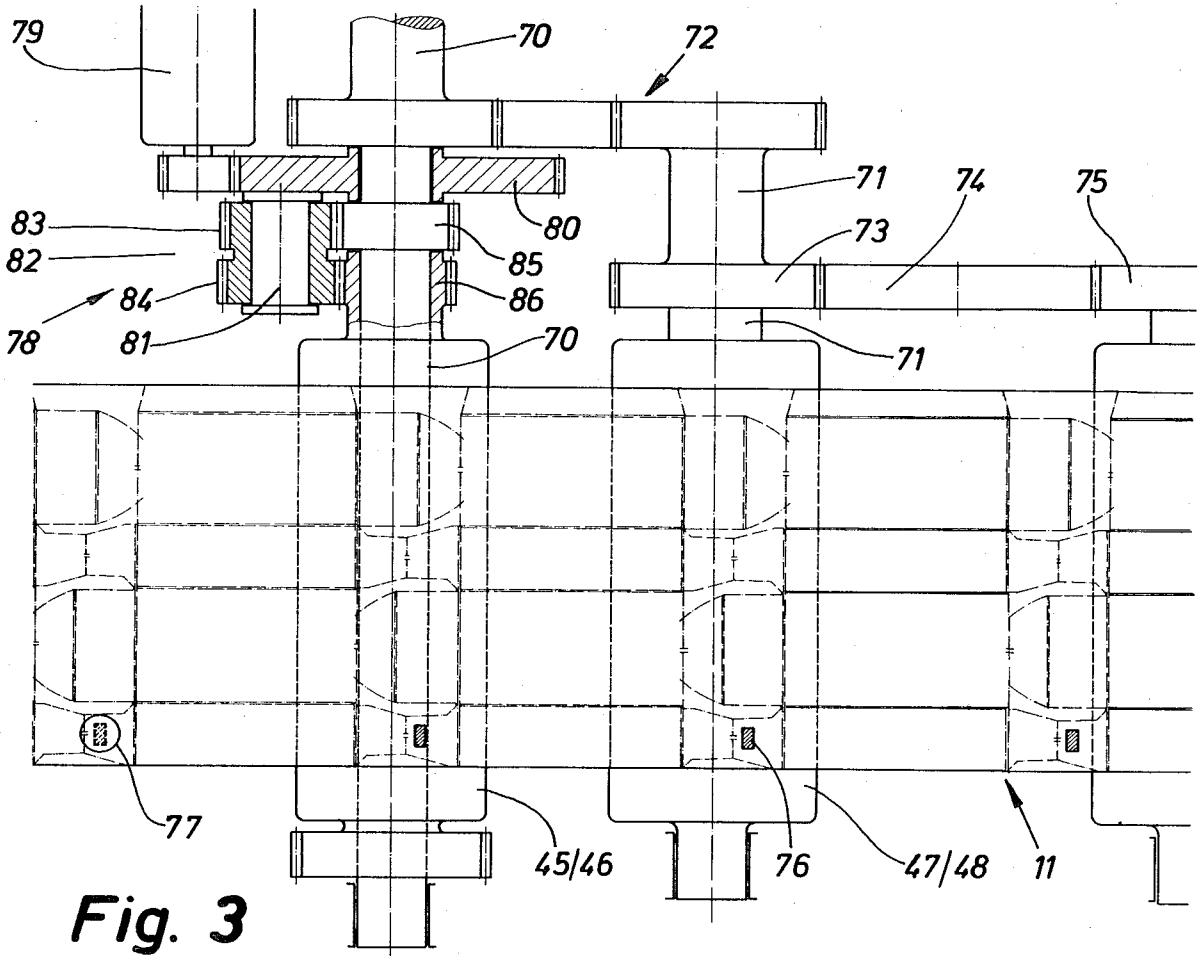
Figure 4:
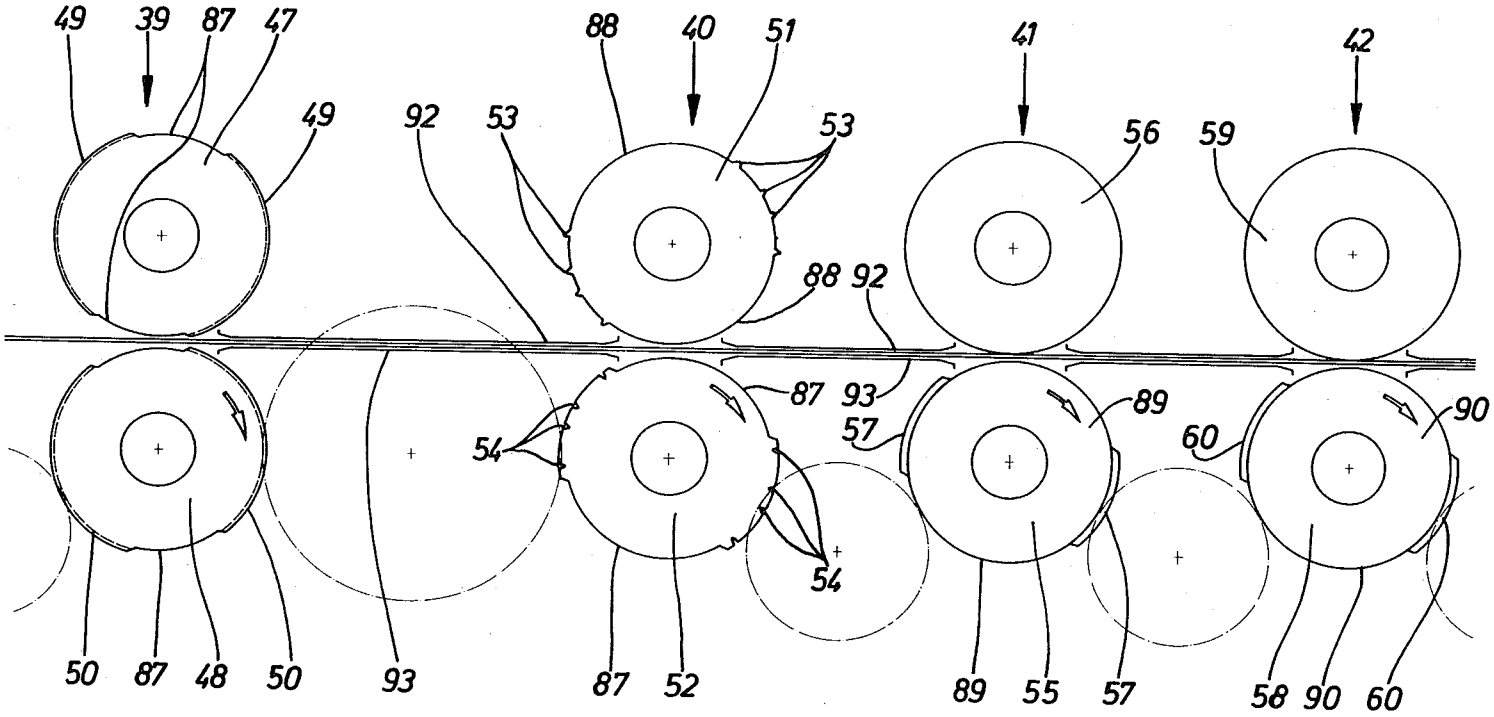
Figure 5:
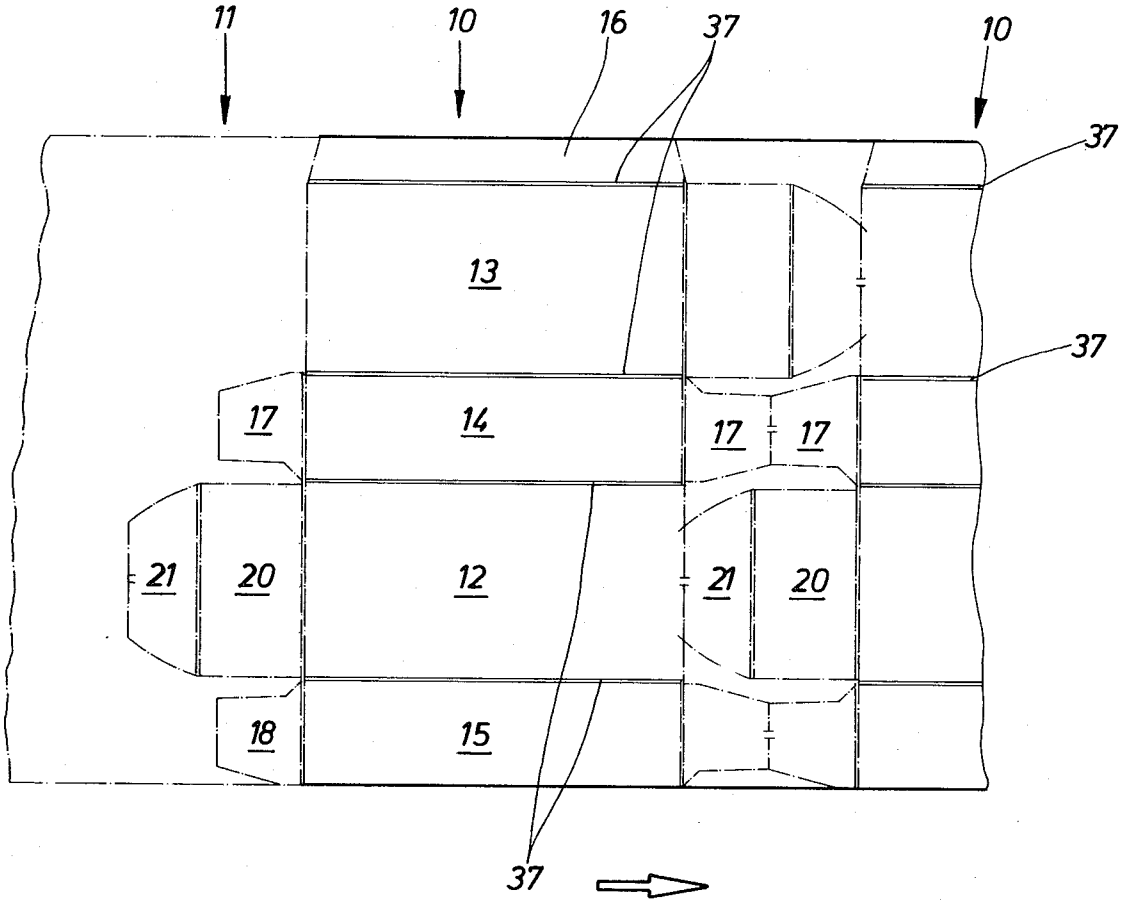
Figure 6:
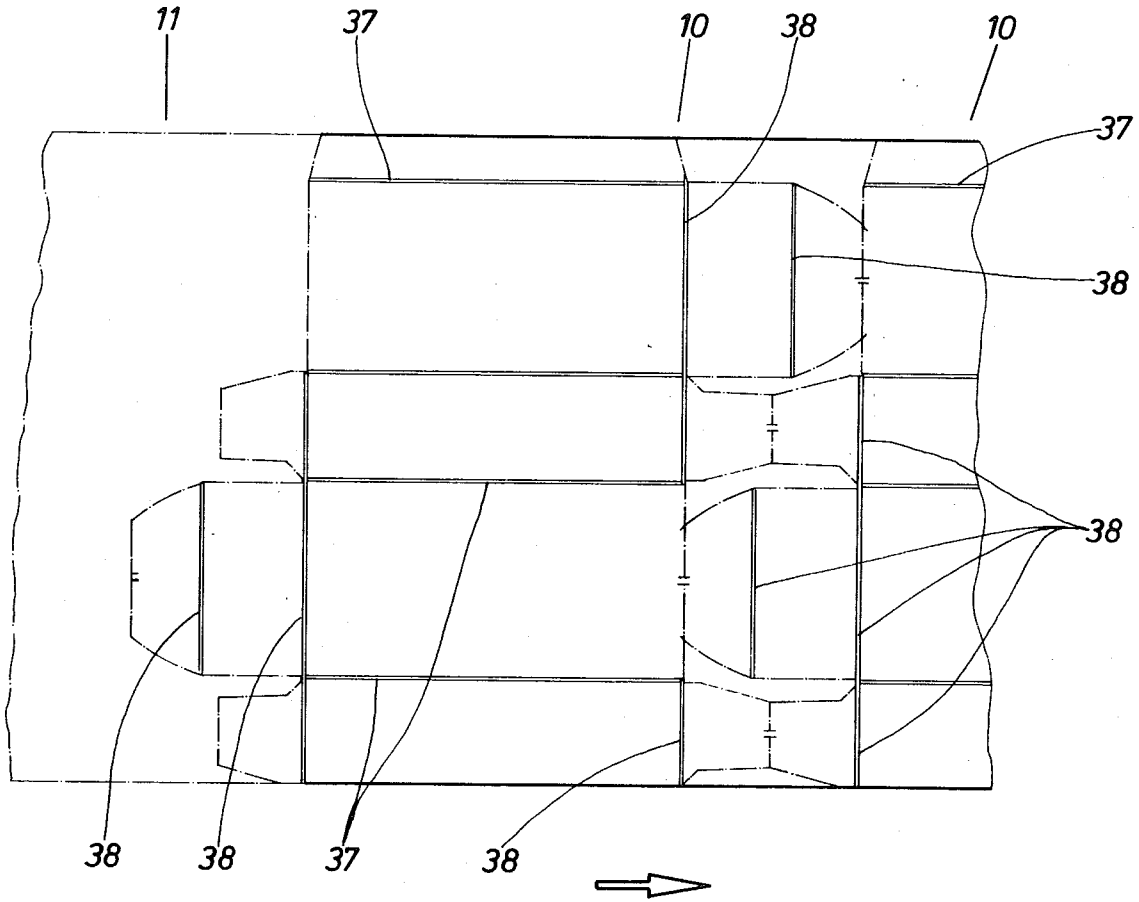
Figure 7:
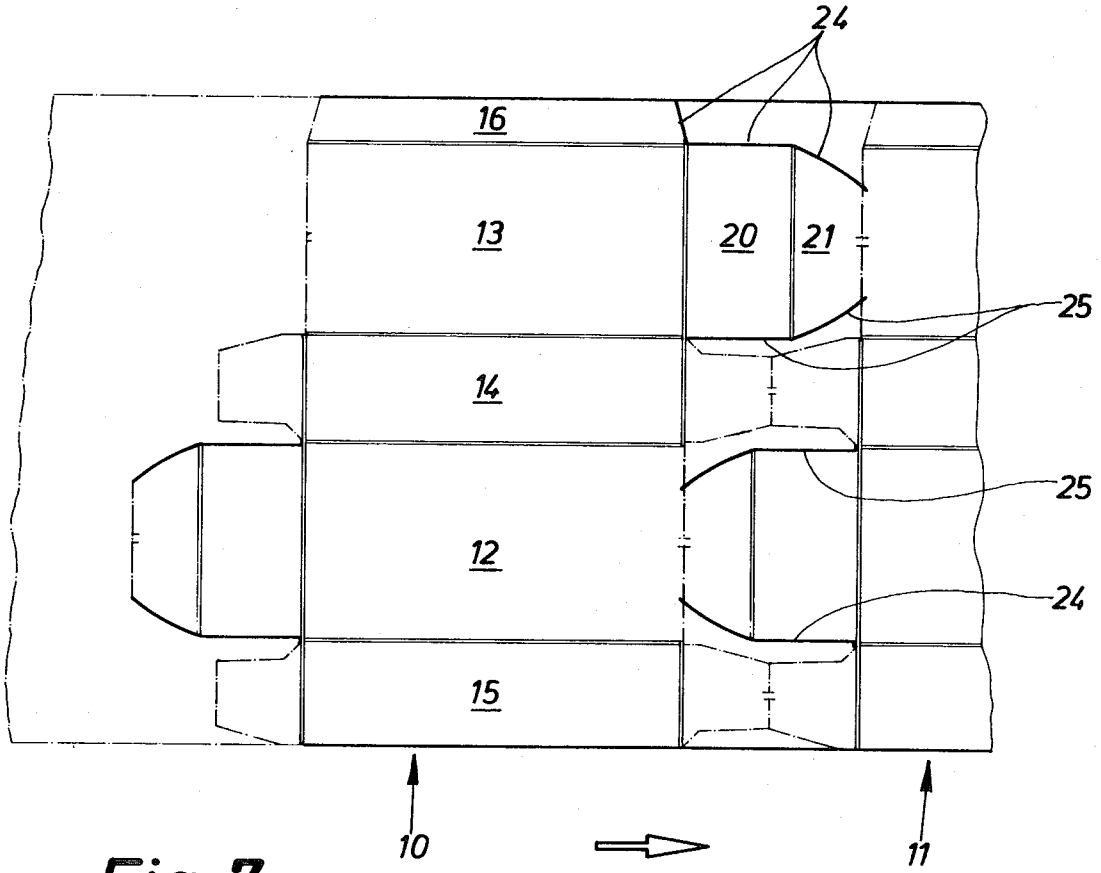
Figure 8:
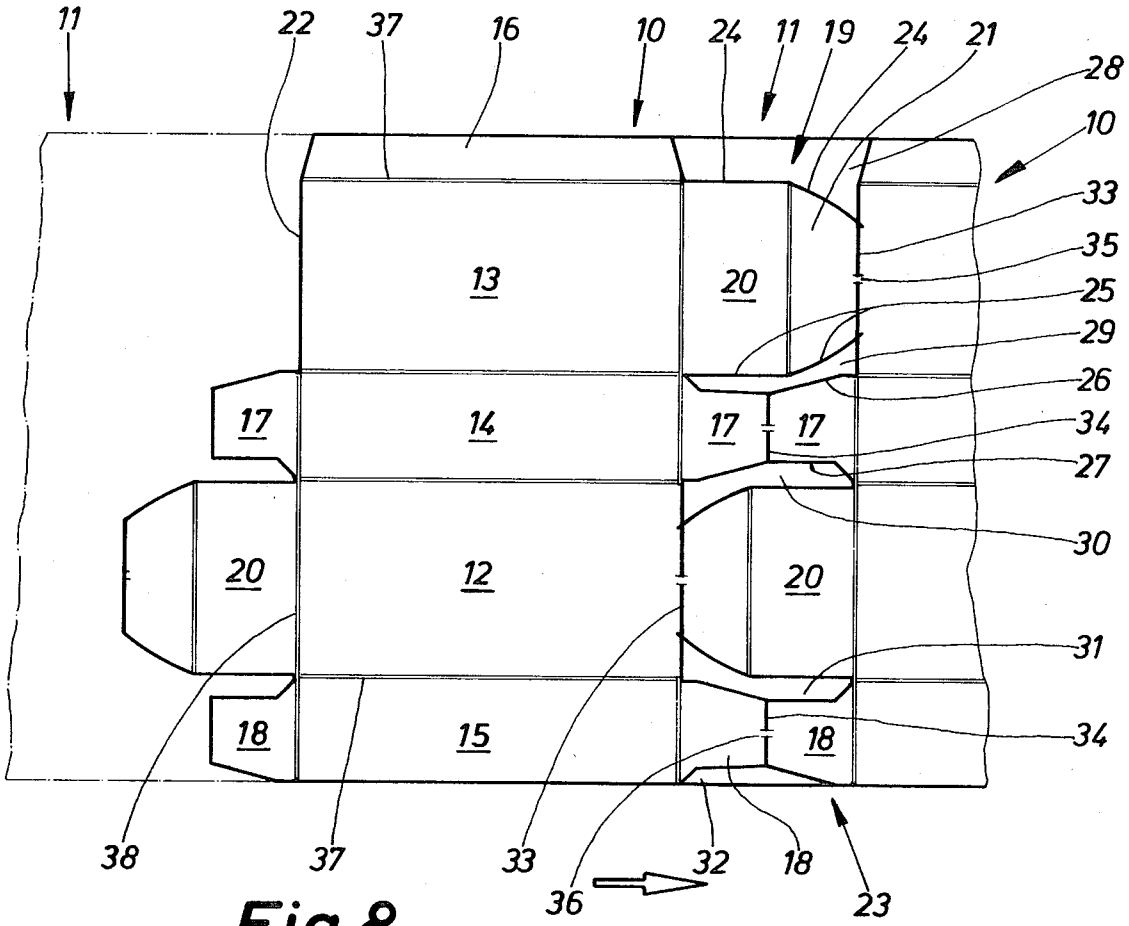
Figure 9:
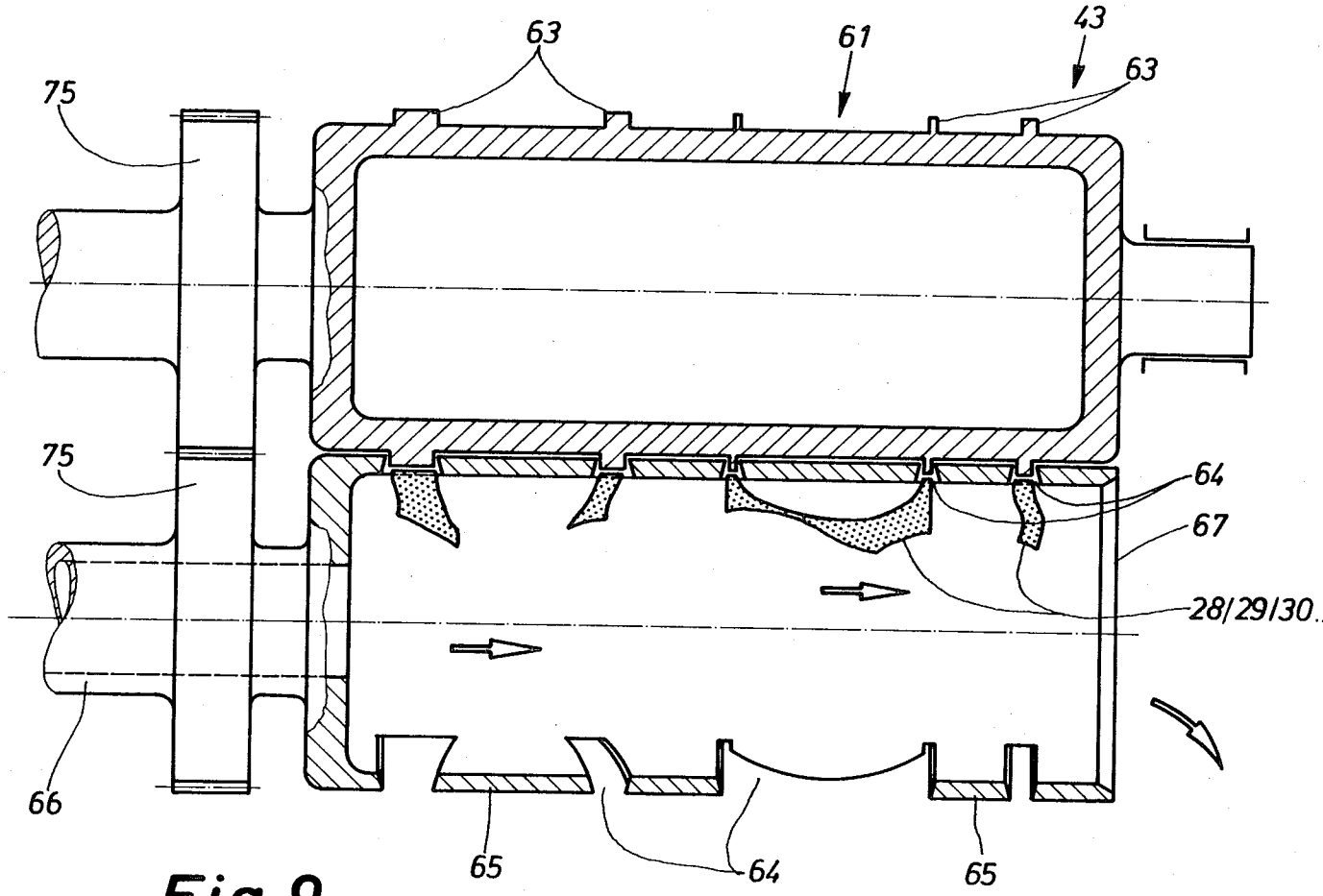

Further details of the process according to the invention and of the apparatus are explained in more detail below with reference to an exemplary embodiment of the apparatus. In the drawing:

FIG. 1 shows the essential features of the apparatus in a diagrammatic plan view, FIG. 2 shows a likewise diagrammatic side view of the apparatus according to FIG. 1, FIG. 3 shows a plan view of a cut-out portion of the apparatus on a scale larger than that of FIG. 1, FIG. 4 shows a side view of a (middle) part of the apparatus on a scale larger than that of FIG. 2, FIG. 5 shows a cut-out portion of the sheet of packaging material after the embossing of longitudinal folding lines, FIG. 6 shows an illustration of the portion of the sheet after the embossing of transverse folding lines, FIG. 7 shows the sheet portion after a first severing cut, FIG. 8 shows the sheet portion after a further severing cut, FIG. 9 shows a vertical section in the region of a station for the removal of waste pieces.

The exemplary embodiment of the apparatus illustrated relates to the production of blanks 10, such as those used extensively in the packaging industry, for example for receiving pharmaceutical and cosmetic products. The blanks 10 are severed in succession from a continuous advancing sheet 11 of packaging material, especially thin cardboard, and are fed to a packaging machine for producing the folding cartons. The blanks 10 extend over the width of the sheet 11, or the width of the latter corresponds to the transverse dimension of a spread-out blank 10.

In the exemplary embodiment illustrated, this consists of marked surface regions for forming a front wall 12, a rear wall 13 and narrower side walls 14 and 15. Joined to the rear wall 13 is a connecting strip 16 which is to be connected to the inside of the outer side wall 15 to form the folding box.

End faces of the folding box are formed by folding tabs. These are side tabs 17 and 18 in the region of the associated side walls 14, 15 and a closing tab 19 joined to the front wall 12 on one side and to the rear wall 13 on the other side, pointing forwards in the transport direction of the sheet 11. The closing tab 19 consists of a covering wall 20 having the dimensions of the end face of the folding box and of a closing tongue 21 attached to the free side of the covering wall 20. The covering wall 20 forms the outer full-surface cover of the two end faces of the folding box, whilst the folded-round closing tongue 21 is pushed into a gap formed on the inside of the front wall 12 or rear wall 13 when the folding box is finished. For this purpose, one edge 22, located opposite the closing tab 19, of the front wall 12 and of the rear wall 13 is free of closing tabs.

In the longitudinal direction of the sheet 11, the dimensions of the closing tabs 19, on the one hand, and of two side tabs 17, 18 adjoining one another and belonging to adjacent blanks 10 are such that they fill in the longitudinal direction a strip of material 23 formed between the box walls 12, 13, 14 and 15 of successive blanks 10. The blanks 10 are thus arranged within the sheet 11 so as to save material.

In the transverse direction, the folding tabs 17, 18, 19 are of complex design. The closing tab 19 is limited, in the region of the covering wall 20, by lateral cutting lines 24 and 25 extending in the longitudinal direction of the sheet 11 as extensions of the lateral limitation of the front wall 12 or rear wall 13. In the present case, the cutting lines 24, 25 are bent slightly and converge in the region of the closing tongue 21. The covering wall 20 is as wide as the adjoining front or rear wall 12, 13.

The side tabs 17 and 18 have in a major part region a smaller width than the adjoining side walls 14, 15. For this purpose, the side tabs 17, 18 are limited b angled cutting lines 26 and 27. Immediately adjacent to the side walls 14, 15, these narrower side tabs 17, 18 have the same width as the associated side walls 14, 15. Consequently, in the region of the strip of material 23 there are folding tabs 17, 18, 19 of adjacent or successive blanks 10. The dimension of the closing tab 19, including the closing tongue 21, corresponds to the width of the strip of material 23. The side tabs 17 and 18 correspond to half the width of the strip of material 23, so that the side tabs 17, 18 of adjacent blanks 10 butt against one another. When a blank 10 is severed, matching folding tabs pointing forwards are thereby exposed at the same time. Because of the shape of the folding tabs 17 to 19, waste pieces 28, 29, 30, 31 and 32 of packaging material of different shapes and sizes are obtained.

To sever the blanks 10 from the following sheet 11, there are transverse cutting lines 33 in the region of the closing tabs 19 and further transverse cutting lines 34 in the region of the side tabs 17, 18, the latter being approximately in the middle of the strip of material 23. The last-mentioned cutting lines 33 and 34 are formed so that narrow residual connections 35 and 36 remain between the adjacent blanks 10 or between the particular blank 10 located at the front and the following sheet of material.

The above-described surface regions of the blank for forming walls and tabs are limited by embossed longitudinal folding lines 37 and transverse folding lines 38. These folding lines 37, 38 are groove-like embossings.

The severing cuts, in particular cutting lines 24 to 27 and 33, 34, and the folding lines 37,38 are made during the uninterrupted transport of the sheet 11, particularly during the continuous conveyance of the latter. Cutting lines and/or folding lines are made in successive steps, specifically according to a particular pattern. For this purpose, the sheet 11 passes through several work stations, in particular a first embossing station 39 for making the longitudinally directed folding lines 37 and then a second embossing station 40 for making the transversely directed folding lines 38. This is followed by a first cutting station 41 for making a specific number of selected cutting lines and a second cutting station 42 for making further cutting lines, in particular the remaining cutting lines. The sheet 11 then passes through a waste removal station 43. Finally, in the region of a severing station 44, the blanks 10 are successively severed, in particular torn off, from the following sheet 11.

In the exemplary embodiment of the apparatus illustrated, the above-mentioned work stations are formed by pairs of rollers. The sheet 11 is moved along a (horizontal) conveyor track and thereby moved between upper and lower rollers located opposite one another.

A first pair of rollers consists of an upper and a lower drawing roller 45, 46. These are driven to rotate and ensure the advance of the sheet 11, at the same time fixing the conveying speed. A subsequent pair of rollers in the region of the first embossing station 39 consists of an (upper) embossing roller 47 and a lower mating roller 48. The embossing roller 47 is provided on the peripheral surface with embossing ribs 49 extending in the peripheral direction, specifically two groups of such embossing ribs 49 arranged at a distance from one another in the peripheral direction, so that two groups of longitudinally directed folding lines 37 are made during each revolution of the embossing roller 47. The embossing ribs 49 are each arranged at an axial distance from one another. In the embossing station 39, a pattern corresponding to that of FIG. 5, with folding lines 37 extending only in the longitudinal direction, is produced in this way. The mating roller 48 is provided, in the region of the embossing ribs 49, with matching grooves 50, likewise in two groups distributed along the periphery.

At a greater distance corresponding, in particular, to the length of the longitudinally directed folding lines 37, a further embossing roller 51 and a mating roller 52 are arranged on both sides of the sheet 11 in the region of the embossing station 40. The embossing roller consists, here, of two groups of embossing ribs 53 extending in the axial direction. These too are arranged so that transversely directed folding lines 38 of two blanks 10 are made during a complete revolution of the embossing roller 51. After the sheet has passed through this embossing station 40, the transversely directed folding lines 38 according to FIG. 6 are now also provided. The mating roller 52 is provided, in the region of the embossing ribs 53, with matching grooves 54 pointing in the axial direction, again in two groups.

In the subsequent (first) cutting station 41, the cutting lines 24 and 25 shown in FIG. 7, for or defining limiting the two closing tabs 19 laterally, are made. For this purpose, a (lower) cutting roller 55 and an (upper) mating roller 56 are provided. The cutting roller 55 is provided, on the peripheral surface, with two groups of projecting cutting knives 57 which correspond in shape and size to the cutting lines 24 and 25 to be made. The cutting knives 57 interact with the smooth-surface mating roller 56. The latter generates the necessary counter pressure during the cutting operation.

In the following cutting station 42, a (lower) cutting roller 58 and an (upper) mating roller 59 are likewise arranged opposite one another. Here again, the cutting roller 58 has a number of cutting knives 60 arranged in two groups and having the dimension, arrangement and shape of the cutting lines 26 and 27, on the one hand, and of the transversely directed cutting lines 33 and 34, on the other hand. The severing cuts required are therefore completed in the cutting station 42 according to the illustration in FIG. 8. The adjacent blanks 10 are severed from one another by means of cutting lines, with the exception of the residual connections 35, 36.

This is followed by the waste removal station 43 which is likewise equipped with two rollers located opposite one another, in particular a pressing-out roller 61 (at the top) and a suction roller 62 (at the bottom). The pressing-out roller 61 is provided on its cylindrical surface with elevations 63, specifically in two groups arranged at a peripheral distance from one another. The elevations 63 correspond in their arrangement, shape and size to the waste pieces 28 to 32. When the sheet 11 runs through the waste removal station 43 after the cutting station 42, the waste pieces 28 to 32 formed previously are pressed out of the plane of the sheet 11, specifically downwards into the suction roller 62, by the correspondingly shaped elevations 63. For this purpose, the suction roller 62 is provided with suction recesses 64 (FIG. 9) in the roller casing 65. In their arrangement, size and shape, the recesses 64 likewise correspond to the waste pieces 28 to 32 to be removed. These are pressed through the recesses 64 into the interior suction roller 62 by the elevations 63 of the pressing-out roller 61.

To eliminate the waste pieces 28 to 32, the suction roller 62 is connected to an air-pressure source. Compressed air is conveyed into the interior of the suction roller 62 via a hollow shaft 66. The hollow suction roller 62 is open on its end face 67 located opposite the hollow shaft 66 arranged on one side, so that the waste pieces 28 to 32 sucked through the recesses 64, are blown off here.

In the region of the severing station 44, the blanks 10, from which the waste pieces 28 to 32 have been removed, are severed from the following sheet 11, specifically by means of drawing rollers 68, 69 which are driven at a slightly higher speed than the above-described pairs of rollers and consequently the sheet 11. As a result of the speed difference, the blanks 10 are torn off in the region of the residual connections 35, 36.

All the pairs of rollers described are driven centrally by means of a motor, not shown in detail, via a main drive shaft 70. This is assigned directly to the (lower) drawing roller 46. From the main drive shaft 70, an intermediate drive shaft 71 is driven via a gear-wheel transmission 72. Located on the intermediate drive shaft 71 assigned to the mating roller 48 of the first embossing station 39 is a gear wheel 73 which drives each of the subsequent pairs of rollers via an intermediate wheel 74 and a drive wheel 75. The drive from the (lower) rollers to the associated opposite rollers of the same pairs of rollers is via appropriate gear wheels shown as an example in FIG. 9 only, so that all the rollers are driven positively.

Assigned to the main drive shaft 70 is a regulating gear 78, by means of which the predetermined differences in position, or those occurring during operation between the sheet 11 on the one hand and the pairs of rollers on the other hand, are compensated. For this purpose, the sheet 11 is provided with printed marks 76 arranged at uniform distances from one another. In the present case, these are arranged in the region of the side tab 18. A photocell 77 installed in a fixed position above the sheet 11 senses the printed marks 76. Any differences in position are detected by the photocell 77 and fed to the regulating gear 78, which is assigned tot he main drive shaft 70. A servomotor 79, which can be driven to the left and to the right and which is connected to the photocell 77, acts on a regulating wheel 80 mounted rotatably on the main drive shaft 70. The regulating wheel 80 is provided with a journal 81, attached off-centre, on which a double gear wheel 82 is mounted rotatably. Individual gear wheels 83 and 84, equipped with different numbers of teeth, for example 48 and 50 teeth respectively, are engaged with mating gear wheels 85 and 86 on the main drive shaft 70. The mating fear wheel 85, equipped with the larger number of teeth, for example with 50 teeth, is fixed on the main drive shaft 70, whereas the second mating gear wheel 86, for example with 48 teeth, is connected to the actual drawing roller 46 and is mounted rotatably together with the latter on the main drive shaft 70. At the same time, the mating gear wheel 86 and the drawing roller 46 are connected to one another. The drive is therefore transmitted from the main drive shaft 70 via the first mating gear wheel 85 to the first individual gear wheel 83 of the double gear wheel 82, from this to the second individual gear wheel 84 and then to the mating gear wheel 86. As a result of slight adjustments of the regulating wheel 80, initiated by means of the servo-motor 79, the drawing rollers 45, 46, responsible for the advance of the sheet, are adjusted and any relative displacements are consequently corrected. As described, the regulating gear 78 acts solely on the drawing rollers 45, 46. Consequently, regulating movements of the drawing rollers 45, 46 for an additional advance or a slight deceleration of the sheet 11 are not transmitted to the pairs of rollers of the work stations.

The necessary adjustments of the drawing rollers 45, 46 in one direction or the other are made during the transport of the sheet 11 and during the unchanged rotation of the pairs of rollers in the work stations. Depending on the sensed shifts in the relative position of the sheet 11, the adjustment of the drawing rollers 45, 46 can have the effect of a slight advance or a slight deceleration. If the pairs of rollers in the work stations are in an appropriate engaged position, this can mean that the sheet 11 will be upset or stretched slightly in the region between the drawing rollers 45, 46 and the embossing station 39.

To compensate such relative shifts of the sheet 11 over its entire length, the pairs of rollers in the work stations (see FIGS. 2 and 4) are designed so that segments 87, 88, 89, 90 and 91, in the region of which the sheet 11 is conveyed free of contact or free of drive, are formed on at least one of the rollers of a pair of rollers (embossing ribs, grooves, cutting knives). In the region of the segments 87 to 91, the respective rollers are free of members (elevations, etc.) engaging with or coming in contact with the sheet 11. The pairs of rollers are adjusted in their relative position in relation to one another, in such a way that work cycles (embossing, cutting, pressing out waste pieces) are always carried out simultaneously at all work stations. Consequently, the segments 87 to 91 also take effect simultaneously for the sheet 11, so that a slight advance or a slight backward shift becomes effective as soon as the segments 87 to 91 are located opposite the sheet 11.

In the region between the pairs of rollers, the sheet 11 is conveyed between fixed upper guides 92 and lower guides 93.

We claim:

1. Process for producing blanks for packs, made of paper, cardboard or like packaging material, by severing them from a longitudinal sheet of packaging material, wherein the blanks are severed from the sheet during conveying of the latter, wherein the sheet is normally conveyed at a constant speed, and wherein each pack has two rectangular main wall panels, (12, 13), two rectangular side wall panels (14, 15), and two rectangular end closures (20), said process characterized by:

severing each blank (10) from the sheet (11) in a plurality of partial cuts which form, from laterally aligned portions of the sheet (11), a pair of closing tabs (19) respectively provided on parts of the sheet (11) forming main wall panels (13, 12) at the trailing and leading edges of successive blanks (10), and each of which comprises one of said end closures and a closing tongue (21), two side tabs (17), respectively provided on parts of the sheet (11) forming side wall panels (14) at the trailing and leading edges of successive blanks (10), between said pair of closing tabs (19), and two side tabs (18), respectively provided on parts of the sheet (11) forming side wall panels (15) at the trailing and leading edges of successive blanks (10), laterally adjacent one of said pair of closing tabs (19), such that the side tabs (17, 18) are laterally narrower than said parts of the sheet (11) forming the side wall panels (14 and 15) on which said side tabs (17, 18) are provided, at least at parts of the side tabs (17, 18) spaced from said parts of the sheet (11) forming the side wall portions (14, 15) on which the side tabs (17, 18) are provided, and gaps are formed between each of the pair of closing tabs (19) and each laterally adjacent side tab (17, 18); and executing said partial cuts in at least two work cycles in which partial cuts are made respectively along opposite sides of said gaps.

2. Process according to claim 1, characterized by: in two successive transverse partial cuts, respectively severing the trailing edge of a first blank (10) from the closing tab (19) at the leading edge of the adjacent trailing blank (10) and severing the closing tab (19) at the trailing edge of said first blank (10) from the adjacent trailing blank (10); and, in an intermediate transverse cut (34), severing the side tabs (17) between said pair of closing tabs (19) and the side tabs (18) laterally adjacent one of said pair of closing tabs (19).

3. Process according to claim 2, characterized by severing the blanks (10) from the sheet (11), with the exception of residual connections (35), and severing the residual connections (35) by tearing.

4. Process according to claim 3, characterised by severing the residual connections (35) by increasing the conveying speed of the sheet (11) downstream of the partial cuts.

5. Process according to claim 3 characterized by making the intermediate transverse cuts (34), with said residual connections (36), at the same time as the second of the two cuts made along opposite sides of said gaps in the second of the two work cycles.

6. Process according to claim 1, characterised by making folding lines (37, 38) defining the pack walls by embossing the sheet during the transport of the sheet (11).

7. Process according to claim 6 characterised by making the folding lines (37, 38) in successive work steps, in such a way that folding lines (37) extending in the longitudinal direction of the sheet (11) are made during a first work step, and that folding lines (38) extending in the transverse direction are made during a second work step.

8. Process according to claim 6, characterized by making the partial cuts and the folding lines (37, 38) in the work stations provided for this purpose.

9. Apparatus for producing blanks for packs by severing them from a longitudinal sheet of packaging material by means of severing cuts (cutting lines), wherein each pack has two rectangular main panels (12, 13), two rectangular side wall panels (14, 15), and two rectangular end closures (20); characterized in that: upper and lower drawing rollers are provided for conveying the sheet (11) in a longitudinal direction; a first embossing station (39) comprising first embossing and mating rollers (47 and 48), respectively provided with first embossing ribs (49) and first grooves (50) which match the embossing ribs (49) arranged in such a way that folding lines (37) extending only in the longitudinal direction can be made in the first embossing station (39), a second embossing station (40) comprising second embossing and mating rollers (51 and 52) respectively provided with second embossing ribs (53) and second grooves (54) which match the second embossing ribs (53) in such a way that only transversely directed folding lines (38) can be made; the embossing stations (39 and 40) are at a distance from one another which corresponds at least to the length of the folding lines (37) extending in the longitudinal direction; and the second embossing station (40) is followed by first and second cutting stations (41 and 42) provided for severing each blank (10) from the sheet (11) in a plurality of partial cuts which form, from laterally aligned portions of the sheet (11), a pair of closing tabs (19) respectively provided on parts of the sheet (11) forming main wall panels (13 and 12) at the trailing and leading edges of successive blanks (10) and each of which comprises one of said end closures (20) and a closing tab (21), two side tabs (17), respectively provided on parts of the sheet (11) forming side wall panels (14) at the trailing and leading edges of successive blanks (10), between said pair of closing tabs (19), and two side tabs (18), respectively provided on parts of the sheet (11) forming side wall panels (15) at the trailing and leading edges of successive blanks (10), laterally adjacent one of said pair of closing tabs (19) such that the side tabs (17 and 18) are laterally narrower than said parts of the sheet (11) forming the side wall panels (14 and 15) on which said side tabs (17 and 18) are provided, at least at parts of the side tabs (17 and 18) spaced from said parts of the sheet (11) forming the side wall panels (14 and 15) on which the side tabs (17 and 18) are provided and gaps are formed between each of the pair of closing tabs (19) and each laterally adjacent side tab (17 or 18), the first cutting station (41) comprising a first cutting roller (55), a first mating roller (56) and first cutting knives (57) attached to the first cutting roller (55) in such a way that, in said first cutting station (41), partial cuts (24, 25) are made along only one side of each of said gaps; and the second cutting station (42) comprising a second cutting roller (58), a second mating roller (59) and second cutting knives (10) attached to the second cutting roller (58) in such a way that, in said second cutting station (42), partial cuts (26, 27) are made along the other side of each of said gaps.

10. Apparatus according to claim 9 characterized in that a waste removal station (43) is provided after the second cutting station (42), and comprises a form tool(61) for pressing waste pieces (28 to 32) out of the plane of the sheet (11) and suction air and compressed air means for removing said waste pieces (28 to 32) from the apparatus.

11. Apparatus according to claim 10, characterized in that the form tool comprises an upper pressing out roller (61) provided with elevations (63), corresponding to the shape of the waste pieces (28 to 32), and a lower hollow suction roller (62) cooperable with the pressing-out roller (61) which is provided with recesses (64) matching the elevations (63) and arranged to receive the elevations (63) as the pressing-out roller (61) and the suction roller (62) rotate together.

12. Apparatus according to claim 11, characterized in that the hollow suction roller (62) has an open end face (67) and a hollow coaxial support shaft (66) through which compressed air can be supplied in order to carry the waste pieces (28 to 32) away through the open end face (67) of the suction roller (62).

13. Apparatus according to claim 12, characterized in that a severing station (44) for severing the blanks (10) from the sheet (11) as result of the tearing of residual connections (35, 36) is provided after the first and second cutting stations (41, 42) and the waste removal station (43), the severing station (44) consisting of at least two interacting drawing rollers (68, 69) which are driven at a higher speed than the conveying speed of the sheet (11).

14. Apparatus according to claim 13, characterized in that the first and second embossing stations (40 and 41), the first and second cutting stations (42 and 43) and the waste removal station (43) are disposed equi-distantly from one another along the longitudinal direction of the sheet of packaging material and the peripheries of co-operating rollers in each said station are formed with segments (87, 88, 89, 90, 91) which are free of embossing ribs, grooves, cutting knives, elevations and recesses and which simultaneously sweep past the sheet (11) of packaging material without drive contact between successive work operations carried out in all of the embossing, cutting and waste removal stations (39, 40, 41, 42, 43).

15. Apparatus according to claim 14, characterized in that a pair of drawing rollers (45, 46) precede the first embossing station (39) and act as a constantly engaged drive for the sheet (11), and a main drive shaft (70) transmits the drive of the drawing rollers (45, 46) to the rollers of the following embossing, cutting, waste removal and severing stations (39 to 44).

16. Apparatus according to claim 15, characterized in that a regulating gear (78) acts on the drawing rollers (45, 46) and a monitoring device (77) for sensing the position of the sheet (11) controls the regulating gear (78) so as to adjust the continuous conveying drive of the sheet (11) in the region of the drawing rollers (45, 46), to thereby adjust the relative position of the sheet (11).

* * * * *